United States Patent [19]

Lickel et al.

[11] 4,322,797

[45] Mar. 30, 1982

[54] X-RAY TUBE FILAMENT CURRENT PREDICTING CIRCUIT

[75] Inventors: Kenneth F. Lickel, Cheshire; Roger Stonebank, Huntington, both of Conn.

[73] Assignee: U.S. Philips Corporation, New York, N.Y.

[21] Appl. No.: 86,901

[22] Filed: Oct. 22, 1979

Related U.S. Application Data

[63] Continuation of Ser. No. 897,731, Apr. 19, 1978, abandoned.

[51] Int. Cl.[3] ..... G06G 7/48; H05G 1/34

[52] U.S. Cl. ..... 364/414; 250/409; 364/571; 364/807

[58] Field of Search ..... 364/861, 807, 414, 415, 364/417, 571; 250/402, 408, 409

[56] References Cited

U.S. PATENT DOCUMENTS

| | | | |
|---|---|---|---|
| 2,840,718 | 6/1958 | Wright et al. | 250/409 X |
| 3,521,067 | 7/1970 | Splain | 250/408 |
| 3,974,387 | 8/1976 | Brönner et al. | 250/409 |
| 3,983,396 | 9/1976 | Mulleneers | 250/402 |
| 4,072,865 | 2/1978 | Craig et al. | 250/409 |

*Primary Examiner*—Joseph F. Ruggiero
*Attorney, Agent, or Firm*—Jack E. Haken

[57] ABSTRACT

An X-ray generator circuit includes a feedback regulator which adjusts X-ray tube filament current to regulate anode current. A predictor circuit is connected to calculate an appropriate filament voltage from preset values of anode current and anode voltage; it functions to control the filament current during a period immediately following application of the anode voltage and when the feedback regulator is ineffective.

4 Claims, 2 Drawing Figures

X-RAY TUBE FILAMENT CURRENT PREDICTING CIRCUIT

This is a continuation of application Ser. No. 897,731, filed Apr. 19, 1978, abandoned.

This invention relates to electric circuits for X-ray generators. More specifically, this invention relates to circuits for determining the filament current in X-ray tubes.

BACKGROUND OF THE INVENTION

Power supply circuits utilized with X-ray tubes generally include controls for independently presetting anode kilovoltage and anode current flow prior to tube operation. Anode current flow is generally adjusted by presetting filament current to a predetermined value which is known to provide the required anode current flow at a selected anode kilovoltage. During application of the anode kilovoltage a feedback regulator may be utilized to control filament current in response to anode current. Such feedback regulators are, however, generally limited by the thermal time constants of the X-ray tube filament structure and do not, therefore, provide adequate regulation during the period immediately following the application of anode voltage to the tube.

Prior art X-ray generators included circuits for presetting the X-ray tube filament current to a value which had been determined, by previous measurement, to provide the preset anode current flow at the preset anode voltage. These prior art generators included a large number of calibration controls. During initial set up of the generator a separate control was adjusted to provide the necessary filament current for each of a large number of separate combinations of preset anode current and anode kilovoltage. Periodic readjustments of these controls were required as X-ray tubes aged or were replaced.

Many modern X-ray facilities include multiple X-ray tubes which are selectively powered from a common X-ray generator. X-ray generators which are operated in this mode required a separate set of filament current adjusting controls for each X-ray tube utilized.

Prior art circuits and methods which attempted to calculate filament current as a mathematical function of anode voltage, preset anode current, and operating time are known, for example, from U.S. Pat. No. 3,983,396, which is incorporated herein, by reference, as background material. Such circuits, however, failed to predict filament current with suitable accuracy and stability.

SUMMARY OF THE INVENTION

X-ray generators of the present invention include a circuit which predicts and controls X-ray tube filament current, during the time period following turn on and prior to stabilization of the feedback current regulator circuit, as a function of preset kilovoltage and anode current values. The filament current is calculated on the basis of a three term equation of the form:

$$I_f = s\left[u + KI_a^w + \frac{x}{cI_a^y + KV + z}\right] \quad (1)$$

wherein the first term, u, represents the preemission point of the X-ray tube; the second term, $$kI_a^w \quad (2)$$

represents the tube emission characteristic in the absence of space charge effects (that is: on the assumption that emission is not a function of anode voltage) and the third term $$\frac{x}{cI_a^y + KV + z} \quad (3)$$

accounts for space charge effects in the tube. In practice, it has been determined that most X-ray tube emission characteristics can be accurately characterized by equation (1) with the constants, u, w, x, y, and z substantially equal, respectively, to 1.38, 0.16, 1.5, −0.667, and −2.4. Only two individual calibration measurements and adjustments must be made for each individual X-ray tube. The value of k which characterizes the tube in the absence of space charge effects is measured and adjusted at a single high kilovoltage-low current value and the value of c, which characterizes the space charge effects in the tube, is measured and adjusted at a single low kilovoltage-high current value. If, as is commonly the case, there are multiple filaments in each X-ray tube separate calibrations must, of course, be performed for each filament. A typical X-ray generator which may, for example, power three X-ray tubes with two filaments in each tube will thus require only twelve separate calibration adjustments in contrast with hundreds of adjustments which were required in prior art X-ray generator equipment of a similar type.

BRIEF DESCRIPTION OF THE DRAWINGS

The preferred embodiments of the invention may be best understood by reference to the attached drawings in which.

DESCRIPTION OF THE PREFERRED EMBODIMENT

Figure 1:
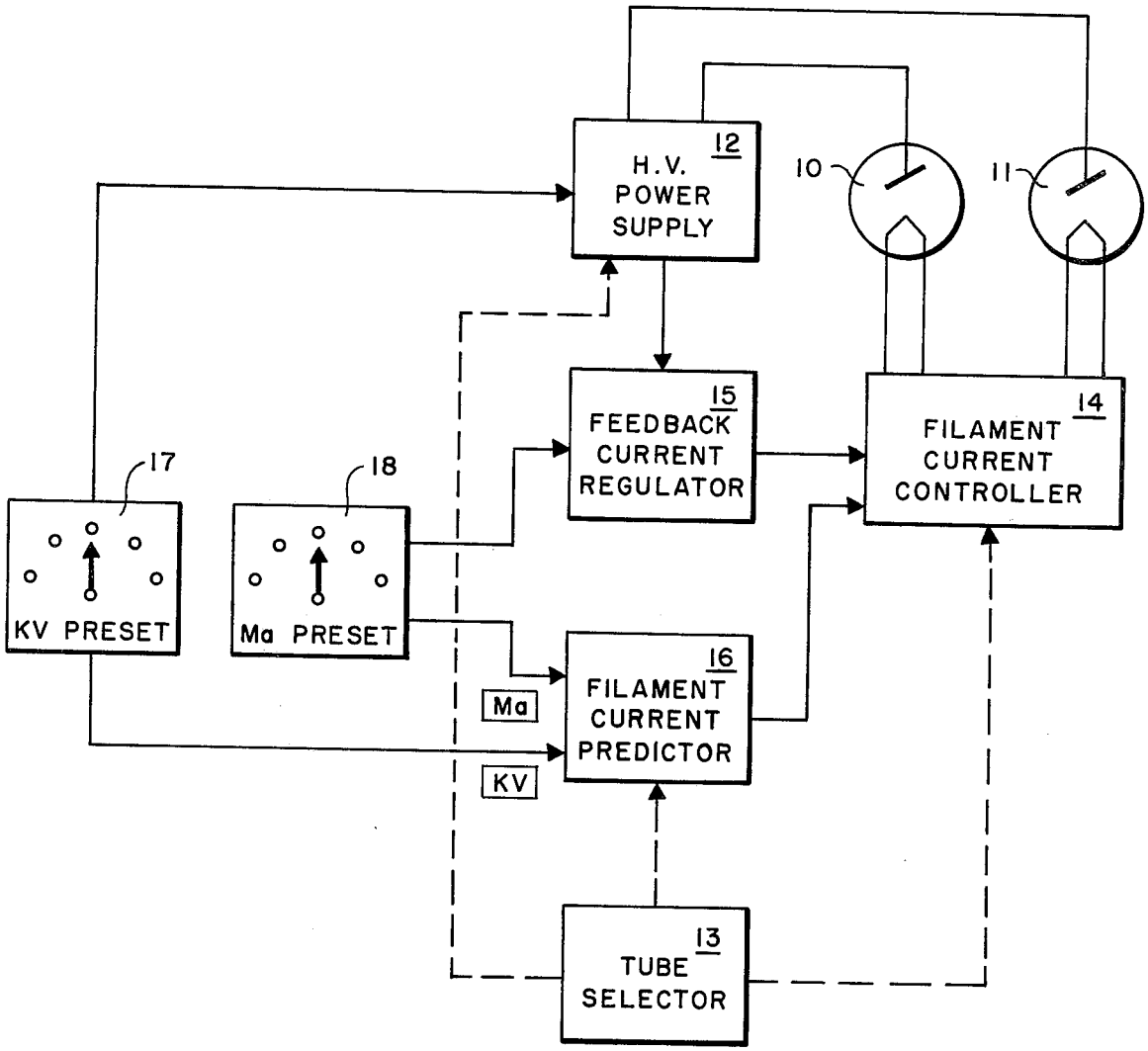
FIG. 1 is a block diagram of an X-ray generator of the present invention and FIG. 2 is a schematic diagram of a predictor circuit of the present invention.

FIG. 1 is an X-ray generator of the present invention. Although a typical X-ray generator might be connected to power three separate X-ray tubes with two filaments in each tube the embodiment of FIG. 1 includes, for clarity of illustration, only two X-ray tubes 10 and 11 each containing a single filament. The extension of the principles illustrated herein to a greater number of X-ray tubes and filaments will be apparent to those skilled in the art. The anodes of the X-ray tubes are, in conventional fashion, connected to a high voltage power supply 12 which includes means for switching the high voltage between the anodes of the tubes 10 and 11 in response to a signal from a tube selector 13. The filaments of the X-ray tubes 10 and 11 are connected to a filament current control 14, which may, by way of example, be similar to the filament current control illustrated in the above referenced U.S. Pat. No. 3,983,386 or similar circuits which are well known in the prior art. The filament controller receives electrical signals from a feedback current regulator 15 and a filament current predictor circuit 16 as well as from the tube selector 13 and adjusts filament current in the operating X-ray tube in response thereto. Controls, which may for example be selector switches, 17 and 18 are disposed on an operators console where they may be utilized to preset, respectively, anode kilovoltage and anode current prior to operation of an X-ray tube. The tube selector 13 typically is also included in the console to allow preselection of a particular X-ray tube for a given exposure.

The anode kilovoltage control 17 provides a signal to the high voltage power supply 12 which varies the anode voltage in a conventional manner. The anode current control 18 similarly provides a conventional signal to the feedback current regulator 15. The feedback current regulator 15 is well known in the prior art and comprises means for sensing the anode current flow through the X-ray tube, for example within the high voltage power supply 12, and for adjusting the filament current, via the filament current controller 14, to stabilize the tube anode current. The time constant of the feedback current regulator 15, which is substantially determined by the thermal inertia of the X-ray tube filament structure, precludes that circuit from effectively regulating tube current during the first approximately 20 milliseconds following application of anode voltage. During that initial 20 milliseconds period filament current is determined by a predictor circuit 16 which, on the basis of analog signals, KV and Ma, derived respectively from controls 17 and 18, predicts and calculates an appropriate filament current value to regulate anode current in the operating X-ray tube.

It has been determined that the filament current which is required to produce a known anode current flow, $I_a$, at a known anode voltage, KV, for a large number of X-ray tubes may be effectively predicted by an analog computer which calculates the value of a filament current controlling voltage $I_f$ from the equation:

$$I_f = s\left[1.38 + KI_a^{0.16} + \frac{1.5}{cI_a^{-0.667} + KV - 2.4}\right] \quad (4)$$

The first term of equation (4) represents the pre-emission point of the X-ray tube filament. In a typical X-ray tube Model SRO 31/100 marketed by Philips Medical Systems, Inc., Shelton, Conn. approximately 0.33 amperes of primary filament current were required to initiate emission.

The second term determines the base line value of filament current, on the assumption that there is no space-charge effect in the X-ray tube; that is, that emission is not a function of the anode voltage.

The third term represents the effects of space charge in the X-ray tube.

The constant, s, is a scale factor which represents the transfer function of the filament current control 14. In a preferred embodiment the constant, s, equals 2 amps of filament current per volt output from the filament current predictor circuit.

Figure 2:
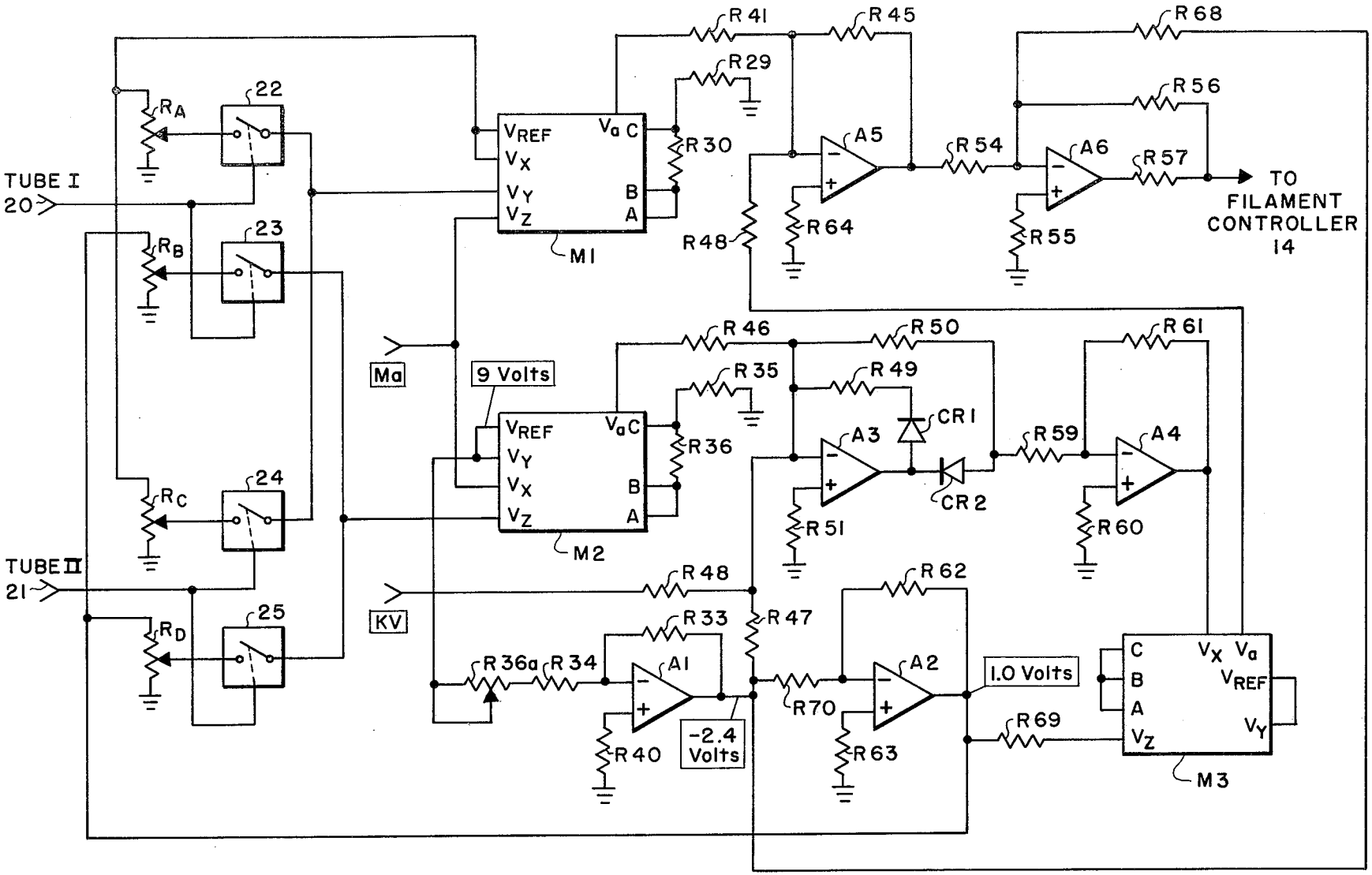

FIG. 2 is a preferred embodiment of the filament current predictor circuit 16. The tube selector 13 (FIG. 1) alternately applies logical "true" levels to the inputs 20 or 21 to indicate the particular X-ray tube (10 or 11 of FIG. 1) in operation. The signals at inputs 20 and 21 are, respectively, applied to the logic inputs of analog switches 22 and 23 or 24 and 25 to respectively connect potentiometers $R_A$ and $R_B$ or $R_C$ and $R_D$ which are preset, in a manner described below, to program the values of constants c and k for each particular X-ray tube.

Amplifier Al is connected, via resistors R34 and R36, to a 9 volt reference voltage $V_{REF}$ and is programmed by feedback resistor 33 and input resistors R34 and R36$_a$ to provide a −2.4 volt reference level at its output. Amplifier A2 is similarly programmed to provide a 1.0 volt output level.

The first term of equation (4) is generated by amplifier A6 which is programmed by resistors R56 and R68 to produce a constant 1.38 volt signal at its output.

The second term of equation (4) is generated by circuit M1 which is a multi-function device whose output voltage $V_a$ is defined as $$V_a = \frac{10}{9}(V_y)\left(\frac{V_z}{V_x}\right)^m \quad (5)$$

where m is a programmable exponent. Multi-function devices having the indicated transfer function are, for example, manufactured by Analog Devices of Norwood, Mass., as part no. AD433J and by others. The transfer function of module M1 may be characterized as $$k(I_a)^m \quad (6)$$

where k equals $V_y$, $I_a$ equals $V_z$, and $V_x$ equals 9($V_{REF}$). The exponent m is programmed by resistors R29 and R30:

$$m = \frac{R29}{R29 + R30} \quad (7)$$

The input Ma from the anode current preset switch 18 (FIG. 1) is applied to the input $V_z$ of the multifunction device M1. The constant k is determined by the setting of potentiometers meters $R_A$ or $R_C$ which are selected by analog switches 22 or 24 in response to signals from the tube selector 13 and is connected to the input $V_y$ of M1.

The constant k is programmed for each tube by adjusting the appropriate potentiometer ($R_A$ or $R_C$) at a high anode kilovoltage (typically 120 kilovolts) and a low anode current (typically 50 milliamps). Selection of a particular tube closes one of the analog switches (22 or 24) which connects one of the potentiometers to M1. The output of M1, which represents the second term of equation (4), is summed into amplifier A5 and then into amplifier A6 which provides the filament current predictor output to the filament current controller 14.

The third term of equation (4) represents the effects of space charge in the X-ray tube. The first term in the denominator $$cI_a{-}0.667 \quad (8)$$

is generated by a multi-function device M2 wherein the exponent m is programmed to the value 0.667 by resistors R35 and R36. The anode current preset signal Ma is applied to input $V_x$ of multi-function circuit M2 and the constant c is determined for each tube by the potentiometers RB and RD which are switchably connected to the input $V_z$ of M2 via the analog switches 23 and 25. The constant c is adjusted for each tube at a low anode voltage (approximately 50 kilovolts and a high operating current where space-charge effects are significant.

The output of M2 is summed in amplifier A3 with the constant −2.4 produced at the output of A1 and with a signal KV representing preset anode voltage which is derived from control 17 (FIG. 1). This sum can be negative, however, rectifier CR2 at the output of A3 limits the signal to non-negative values. This signal is inverted in amplifier A4 and is fed to the $V_x$ input of multi-function circuit M3 which is connected as a divider and serves to calculate the indicated reciprocal. The output of M3 is connected to the input of amplifier A5 and is multiplied therein by a scale factor, 0.15, determined by resistors R48 and R45. The combination of amplifiers A5 and A6 is used to sum the three terms of equation (4) and to apply the appropriate scale factor to achieve the predictor output which is applied to the filament current controller.

The circuit of FIG. 2 thus allows prediction and control of X-ray tube filament current during the interval immediately following the application of anode voltage, during which feedback control is inadequate. The circuit may be easily constructed during standard multi-function analog modules. Only two calibration adjustments (one performed at high voltage and low current, the other at low current and high voltage) are required for each X-ray tube; a feature which greatly simplifies installation and maintainence of generator apparatus.

We claim:

1. An X-ray generator circuit for powering an X-ray tube of the type including means for supplying a predetermined anode voltage to said tube; means for supplying and controlling a filament current in said tube in response to a filament control signal; and feedback regulator means for adjusting said filament control signals in response to anode current flow in said tube to stabilize said anode current at a preset value; and further comprising, as an improvement;

a circuit for predicting the filament current necessary to produce said preset value of anode current in said tube, connected to receive an input voltage, KV, representative of the predetermined anode voltage and an input voltage, $I_a$, representative of the preset anode current and to calculate therefrom a filament control voltage $I_f$ from a function substantially equal to $$I_f = S\left[1.38 + kI_a\,0.16 + \frac{1.5}{cI_a^{-0.667} + KV - 2.4}\right];$$

said circuit for predicting the filament current being connected to control the filament current during a period immediately following the application of anode voltage and when the feedback regulator means are ineffective for regulating the anode current.

2. An improved method for calibrating and operating an X-ray generator which provides filament current, kilovoltage, and anode current to an X-ray tube, wherein the X-ray generator includes means for predicting a filament current necessary to produce a predetermined anode current when the X-ray tube is operating with a known kilovoltage, said means including a computer connected to receive an input voltage, KV, representative of the known X-ray tube kilovoltage and an input voltage, $I_a$, representative of the predetermined anode current and to calculate therefrom a filament current control voltage, $I_f$, in accordance with the relationship:

$$I_f = s\left[u + KI_a^w + \frac{x}{cI_a^y + KV + z}\right]$$

wherein u represents the pre-emission filament current of the X-ray tube;

$$kI_a^w$$

is a baseline term, and $$\frac{x}{cI_a^y + KV + z}$$

is a term representative of the effects of space-charge in the tube; comprising the steps of:

(A) first calibrating the means for predicting by (i) first determining the value of the constant k by measuring the actual filament current applied to the X-ray tube while operating the X-ray tube at a single high kilo-voltage value and a low current value, in the absence of significant space-charge effects, and by entering said value of the constant k as an input to the computer; and (ii) by then determining the value of the constant c by measuring the actual filament current applied to the tube filament current at a single low kilovoltage value and a high current value, where space-charge effects predominate, and by entering the value of the constant c as an input to the computer; and (B) then utilizing the generator for normal operation of the X-ray tube by: (i) applying a known kilovoltage to said tube; (ii) maintaining the filament current of the X-ray tube at a value determined by the filament current control voltage during a period which immediately follows application of said known kilovoltage; and (iii) then measuring actual anode current flow from the generator, comparing said measured anode current with the predetermined anode current, and controlling the filament current of the X-ray tube to minimize the result of said comparison.

3. The method of claim 2 wherein u, w, x, y and z are, respectively, substantially equal to 1.38, 0.16, 1.5, −0.667, and −2.4.

4. The method of claim 2 or 3 wherein the X-ray tube includes a plurality of filaments and wherein the steps (A) of calibrating the means for predicting are repeated for each filament.

* * * * *